United States Patent [19]

Ophey

[11] 4,106,868

[45] Aug. 15, 1978

[54] ELECTROGRAPHIC COPYING APPARATUS WITH SURFACE-TO-SURFACE IMAGE TRANSFERS

[75] Inventor: Petrus J. M. Ophey, Grubbenvorst, Netherlands

[73] Assignee: OCE-van der Grinten N.V., Venlo, Netherlands

[21] Appl. No.: 737,049

[22] Filed: Oct. 29, 1976

[30] Foreign Application Priority Data

Nov. 5, 1975 [NL] Netherlands ..... 7512987

[51] Int. Cl.[2] ..... G03G 15/00

[52] U.S. Cl. ..... 355/3 TR; 96/1.4

[58] Field of Search ..... 355/3 TR, 3 TE, 3 R; 96/1.4; 101/DIG. 13; 118/212

[56] References Cited

U.S. PATENT DOCUMENTS

| | | | |
|---|---|---|---|
| 2,357,809 | 9/1944 | Carlson | 355/3 R |
| 2,781,278 | 2/1957 | Harmon | 118/212 X |
| 2,807,233 | 9/1957 | Fitch | 101/DIG. 13 |
| 2,889,758 | 6/1959 | Bolton | 96/1.4 X |
| 3,006,317 | 10/1961 | Showalter | 118/212 |
| 3,318,212 | 5/1967 | Rubin | 355/3 TR |
| 3,832,055 | 8/1974 | Hamaker | 355/3 TR |
| 3,851,964 | 12/1974 | Smith et al. | 96/1.4 X |
| 3,936,170 | 2/1976 | Shiband et al. | 355/3 TR |
| 3,947,113 | 3/1976 | Buchan et al. | 355/3 R |
| 3,978,268 | 8/1976 | Kameda et al. | 355/3 TE |

*Primary Examiner*—R. L. Moses

*Attorney, Agent, or Firm*—Albert C. Johnston

[57] ABSTRACT

In electrographic copying apparatus of the type in which a powder image is transferred from a moving surface to a surface moving in pressing contact with it and then is transferred from the latter surface to a sheet of copy paper, pollution of the transfer station by powder is avoided by providing one of the two surfaces with at least one receding surface portion which recedes away from the other surface so as not to make contact with it, and causing a receding surface portion to be positioned opposite to the other surface so that the two surfaces are not in contact when no image transfer is being effected, such, for instance, as when powder images are not being formed or when a copy sheet is not being supplied so as to receive an image formed. Preferably, a roller for receiving and transferring each powder image from a moving photoconductive belt or drum is provided with two diametrically opposite receding surface portions located between two image receiving surface portions each of which is formed by a soft resilient coating layer, the area of which is the same as or slightly smaller than that of the sheet of copy paper.

6 Claims, 1 Drawing Figure

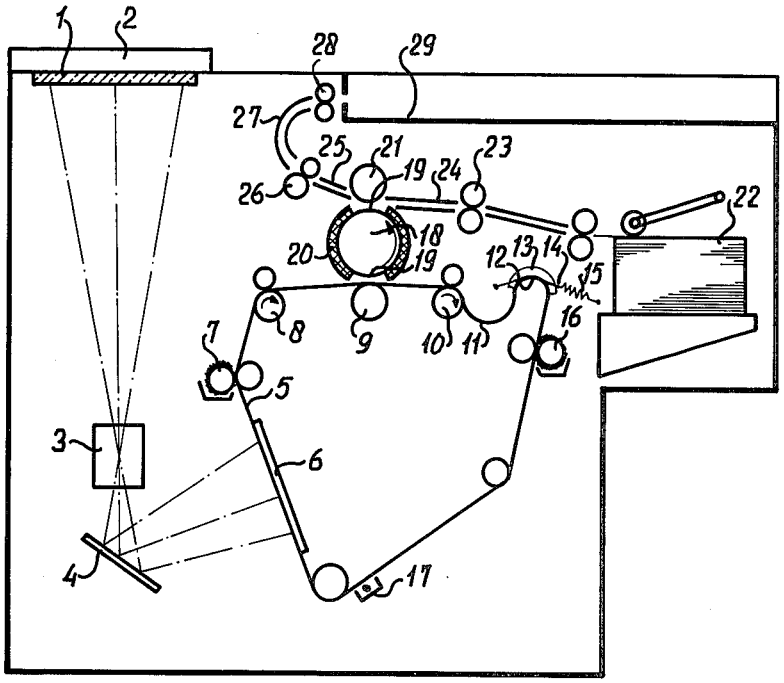
1
2
28
29
27
25
21
19
24
23
26
22
18
20
19
12
13
14
15
16
7
8
9
10
11
5
3
6
4
17

ELECTROGRAPHIC COPYING APPARATUS WITH SURFACE-TO-SURFACE IMAGE TRANSFERS

This invention relates to an electrographic copying apparatus in which a powder image is transferred from one moving surface to another, and from the latter to a sheet of copy paper, while the surfaces are in pressing contact with one another.

In a known apparatus of that type, for instance as described in U.S. Pat. No. 3,591,276, after a latent image is formed by exposure on a drum or belt having a photoconductive layer coated on an electrically conductive layer, the image is developed by applying a powder to it, and the powder image thus formed is transferred from the photoconductive layer by contacting it under pressure with a belt or drum having a surface of soft, resilient material, for instance silicone rubber. Then the powder image is transferred to a copy paper which is pressed against the receiving belt or drum by a pressure roller.

A disadvantage of such systems is that quite some pollution occurs in the transfer station. This occurs in part because of difficulty in keeping the moving surfaces in exact synchronism, as a result of which portions of the power image stay behind on parts of the transfer station instead of being transferred to the copy paper. Pollution may also occur because of powder being supplied at moments and at places not desired, for instance upon faulty exposure during the formation of the charge image, or when copy paper is not present to receive the powder image, or due to other faults. The moving surface which receives the powder image from the photoconductive layer can be heated to make the powder particles sticky and thus easier to transfer to the copy paper, but this increases the chance of pollution because the powder staying behind adheres to the receiving surface or to the pressure roller.

It has been proposed to employ suction devices for removing powder from places where it is not desired during the formation of powder images. This, however, does not solve the pollution problem satisfactorily in the case of transfer systems of the type above mentioned.

The object of the present invention is to provide a transfer system of that type by which the chance of pollution is substantially reduced or minimized.

For this purpose, according to the invention, a copying apparatus of the type mentioned above is characterized in that one of surfaces mentioned has at least one portion thereof recessed so that this receding surface portion cannot make contact with the other surface, and means are provided in the drive means for the surfaces whereby a receding surface portion is positioned opposite to the other surface, so that the two surfaces make no contact with each other, when no image transfer is being effected. The invention preferably is carried out by providing the image receiving surface on a roller or drum having two receding surface areas lying diametrically opposite to each other.

In this way, polluting powder particles are prevented from being transferred from the one moving surface to the image receiving surface when no image transfer is being effected. This is the case, for instance, when no images are being formed but the apparatus is in a standby condition with the one surface being driven at a low speed, or when, even though images are indeed formed, copy paper for some reason fails to be supplied so as to pick up an image. In such situations the powder not transferred will stay behind on the one surface, but this need not cause pollution since the one surface can easily be cleaned; it usually is smooth, and the powder on it has not yet been made sticky by heating.

It is particularly desirable according to the invention to make the portions of the image receiving surface which lie between the receding surface portions with length and width dimensions the same as or slightly smaller than these dimensions of the copy paper. This makes it possible to prevent powder from being transferred to areas of the receiving surface which do not come into contact with copy paper during the image transfer, and in this way pollution during the image transfer is substantially completed prevented.

The invention will be further understood from the following description and the accompanying schematic drawing of an apparatus embodying the invention.

In the illustrated apparatus, an orginal to be copied can be laid down on a glass plate 1 and covered by a hinging cushion 2. The original is then exposed by means of flash lamps (not shown), whereby, via a lens 3 and a mirror 4, an image of the original is formed on an endless belt 5 carrying a photoconductive layer on an electrically conductive layer. The belt is kept flat in the exposing station by being passed over a suction box 6. Subsequently, the belt 5 passes through a developing station 7 where the electrostatic charge image is developed by a powder, then over a drive roller 8 working with or without a counter pressure roller, and then over a pressure roller 9 in a transfer station. The belt 5 then passes over a smooth drive roller 10, beyond which it forms a loop 11 leading onto a stationary guide member having a smooth or hairy surface 12, where it is kept aligned by lateral guides 13 by being held pressed against the surface 12 by a cloth 14 tightened by a spring 15. Subsequently the belt passes through a cleaning station where superfluous powder is removed by a brush 16, and from there the belt passes a corona device 17 where a uniform electric charge is brought onto the photoconductive layer so that a charge image can be formed on the charged layer by an imagewise exposure to light at the location of the suction box 6.

Above the belt 5 at a location opposite to the pressure roller 9 there is a powder receiving roller 18 which is provided with a soft resilient coating layer 20 on two opposite portions of its surface. The coating or surface layer 20 is composed, for instance, of a soft silicone rubber. The roller 18, taking into consideration some compression of its coating 20, is driven with the same circumferential speed as the belt 5. Thus, during the transfer of a powder image carried on the belt 5 the powder particles of the image will stick readily to the soft coating 20 of the roller 18, and will thus come loose from the belt 5.

Above the roller 18 there is a pressure roller 21 which can press a sheet of copy paper against the roller 18. The copy paper is supplied from a pile 22 via feed rollers 23 and a guide 24 which directs the sheet between the rollers 18 and 21. Thus the powder image is transferred from roller 18 to the copy paper, which paper then moves through guides 25, between moving rollers 26, through guides 27, and finally between moving rollers 28 to a receiving tray 29.

According to the present invention, the roller 18 is provided with two receding surface portions 19 lying diametrically opposite to each other. These receding or recessed portions as here indicated are portions of the roller surface on which there is no coating 20. As a result, when the roller 18 stands in the position shown in the drawing, the lower receding portion does not make contact with the belt 5.

The surface portions of the coating 20 which are located at either side of the recesses 19 have a size which is as large as or slightly smaller than the size of the sheets in pile 22. For instance, when these sheets are of size A4, the surface portions at 20 can be of the same size, or can have a surface of about 208 mm × 295 mm in dimensions.

The roller 18 is driven by a drive of any desired kind by which the roller 18 will be stopped in a position such as that illustrated when no image transfer is being effected. Consequently, the belt 5 then can pass freely below the roller 18 without contacting its surface, and therefore cannot transfer any powder to the roller 18. The stopping of the roller 18 can be effected in ways well known per se, for instance by an electromagnetically actuated device that will cause a clutch to be disengaged and a brake engaged in the drive to this roller in response to a signal occurring when no image is being formed on an area of the belt 5 passing through the exposing path at 6, or when no copy sheet is moving through the paper feed path to roller 18 so as to receive a powder image already formed on the belt 5. During the transfer of an image, the roller 18 of course is rotated through a complete revolution, being turned through half a revolution to pick up the image and through another half revolution for transfer of the image to the copy paper in cooperation with roller 21.

By making the roller 18 relatively larger, its surface can be provided with more than two powder receiving surface areas with receding surface areas between them. It is of course also possible to employ, instead of a roller 18, a belt which has receding areas, like those at 19, between image receiving areas on its surface.

What is claimed is:

1. In an electrographic copying apparatus including a movable electrographic surface for carrying and transferring a powder image to an intermediate surface moving in pressing contact with it and means for moving a sheet of copy paper in contact with the intermediate surface for transferring the image from the latter surface to the sheet of copy paper, the improvement which comprises said intermediate surface having at least one receding portion each of which recedes away from the intermediate surface so that said portion cannot make contact with the electrographic surface, and means whereby a said receding surface portion is positioned opposite to said electrographic surface so that the electrographic surface and the intermediate surface make no contact with each other when no image transfer is to be effected.

2. Copying apparatus according to claim 1, said intermediate surface being on an image receiving roller having thereon two of said receding surface portions lying diametrically opposite to each other.

3. Copying apparatus according to claim 2, each of the portions of said roller surface which are located between said receding surface portions having a length and width the same as or slightly smaller than the length and width of the sheet of copy paper.

4. Copying apparatus according to claim 2, each of the portions of said roller surface which are located between said receding surface portions being formed by a coating layer of soft silicone rubber having a length and width the same as or slightly smaller than the length and width of the sheet of copy paper, said receding surface portions being areas of said roller surface on which there is no such coating layer.

5. In an electrographic copying apparatus including a movable photoconductive belt for carrying and transferring a powder image to an intermediate surface moving in pressing contact with it and means for moving a sheet of copy paper in contact with the intermediate surface for transferring the image from the latter surface to the sheet of copy paper, the improvement which comprises said intermediate surface having at least one receding portion each of which recedes away from the intermediate surface so that the receding surface portion cannot make contact with the photoconductive belt surface, and means whereby a said receding surface portion is positioned opposite to said belt surface so that the belt surface and the intermediate surface make no contact with each other when no image transfer is to be effected, said intermediate surface being on an image receiving roller having thereon two of said receding surface portions lying diametrically opposite to each other, each of the portions of said roller surface between said receding surface portions being formed by a coating layer of soft silicone rubber having a length and width the same as or slightly smaller than the length and width of the sheet of copy paper, said receding surface portions being areas of said roller surface on which there is no such coating layer.

6. The method of electrographic copying which comprises forming powder images on respective areas, separated from each other by non-imaged areas, of an endless electrographic surface being moved continuously through an imaging station and thence through a first image transfer station and a surface cleaning station in succession;

during the movement through said transfer station of each imaged area from which a copy is to be made pressing in contact with said imaged area a transfer portion of a second endless surface being moved through said transfer station and moving a copy sheet toward a second transfer station located in the path of said second surface at a distance away from the electrographic surface, said transfer portion being one of at least two transfer portions of said second surface, to any one of which a powder image will be adhered by such pressing contact and between each two of which there is a receding portion of said second surface that will not contact the electrographic surface;

moving said transfer portion and said copy sheet together into and through said second transfer station and transferring therein an adhered powder image from said transfer portion to said sheet;

and during the movement through said first transfer station of either a non-imaged area of the electrographic surface or an imaged area thereof from which a copy is not to be made, positioning a said receding portion of said second surface in said first transfer station so that no powder will be transferred therein from the electrographic surface.

* * * * *